US011718098B2

(12) United States Patent
Pettingill et al.

(10) Patent No.: US 11,718,098 B2
(45) Date of Patent: Aug. 8, 2023

(54) DEVICE TO SUPPLY PRINTING MATERIAL

(71) Applicant: Hewlett-Packard Development Company, L.P., Spring, TX (US)

(72) Inventors: Justin Pettingill, Boise, ID (US); Gabriel McDaniel, Boise, ID (US); Jeffrey H. Luke, Boise, ID (US); Sean Daniel FitzGerald, Boise, ID (US)

(73) Assignee: Hewlett-Packard Development Company L.P., Spring, TX (US)

( * ) Notice: Subject to any disclaimer, the term of this patent is extended or adjusted under 35 U.S.C. 154(b) by 61 days.

(21) Appl. No.: 17/311,812

(22) PCT Filed: Jul. 8, 2019

(86) PCT No.: PCT/US2019/040825
§ 371 (c)(1),
(2) Date: Jun. 8, 2021

(87) PCT Pub. No.: WO2021/006867
PCT Pub. Date: Jan. 14, 2021

(65) Prior Publication Data

US 2022/0118765 A1 Apr. 21, 2022

(51) Int. Cl.
*B41J 2/175* (2006.01)

(52) U.S. Cl.
CPC ..... *B41J 2/17509* (2013.01); *B41J 2/17503* (2013.01); *B41J 2/17506* (2013.01); *B41J 2/17513* (2013.01); *B41J 2/17523* (2013.01)

(58) Field of Classification Search
CPC .. B41J 2/175; B41J 29/17503; B41J 2/17506; B41J 2/17509; B41J 2/17513; B41J 2/17523; B41J 29/02; B41J 29/13; B41J 29/38
See application file for complete search history.

(56) References Cited

U.S. PATENT DOCUMENTS

| | | | | |
|---|---|---|---|---|
| 6,386,692 | B1 | 5/2002 | Cowger et al. | |
| 6,540,321 | B1 | 4/2003 | Hirano et al. | |
| 7,771,031 | B2 | 8/2010 | Silverbrook et al. | |
| 2005/0157106 | A1 | 7/2005 | Silverbrook et al. | |
| 2005/0163536 | A1 | 7/2005 | Miller | |
| 2006/0164475 | A1* | 7/2006 | Umeda | B41J 2/14209 347/85 |
| 2008/0239034 | A1 | 10/2008 | Umeda | |

(Continued)

FOREIGN PATENT DOCUMENTS

| | | |
|---|---|---|
| CN | 101253047 | 8/2008 |
| CN | 101754860 | 6/2010 |
| CN | 101804392 | 8/2010 |

(Continued)

*Primary Examiner* — Anh T Vo
(74) *Attorney, Agent, or Firm* — Foley & Lardner LLP

(57) ABSTRACT

A device to supply printing material to a printing material container of a printing apparatus includes a container including a plunger and to contain the printing material, a portal couplable to a refill port to the printing material container. The portal includes a discharge port through which the printing material is transferrable from the container, and a connector to receive power to move the plunger, to cause a transfer of the printing material contained in the container to the printing material container through the discharge port.

15 Claims, 18 Drawing Sheets

(56) References Cited

U.S. PATENT DOCUMENTS

| | | | | |
|---|---|---|---|---|
| 2008/0273046 | A1* | 11/2008 | Ishinaga | B41J 2/17596 347/6 |
| 2009/0096849 | A1 | 4/2009 | Kanbe et al. | |

FOREIGN PATENT DOCUMENTS

| | | | |
|---|---|---|---|
| CN | 102139576 | | 8/2011 |
| CN | 104589653 | | 5/2015 |
| CN | 108349256 | | 7/2018 |
| CN | 207772603 | U | 8/2018 |
| CN | 109791388 | | 5/2019 |
| EP | 0570981 | A1 | 11/1993 |
| EP | 0709206 | A2 | 5/1996 |
| EP | 0603910 | B1 | 4/1997 |
| EP | 3421141 | | 1/2019 |
| JP | 2002254668 | A | 9/2002 |
| JP | 2006110919 | A | 4/2006 |
| JP | 2011126036 | A | 6/2011 |
| JP | 2018176533 | A | 11/2018 |
| JP | 2019042939 | A | 3/2019 |

* cited by examiner

DEVICE TO SUPPLY PRINTING MATERIAL

BACKGROUND

A printing apparatus performs printing using printing material such as toner. A printing apparatus includes a solution that may hold, store and/or contain printing material and supply or distribute/emit print material to be used by the printing apparatus in creating visual or tactile and/or three-dimensional prints or structures. For example, a printing apparatus may include a printing material container such as a printing cartridge that contains and supplies the printing material to be used by the printing apparatus to perform printing. When the printing material contained in the printing material container or the printing cartridge is exhausted, the printing cartridge may be decoupled and removed from a body of the printing apparatus, and a new printing cartridge may be inserted or coupled to the printing apparatus. The printing cartridge may also be supplied, resupplied, reloaded, or refilled with additional printing material.

DETAILED DESCRIPTION

Figure 1:
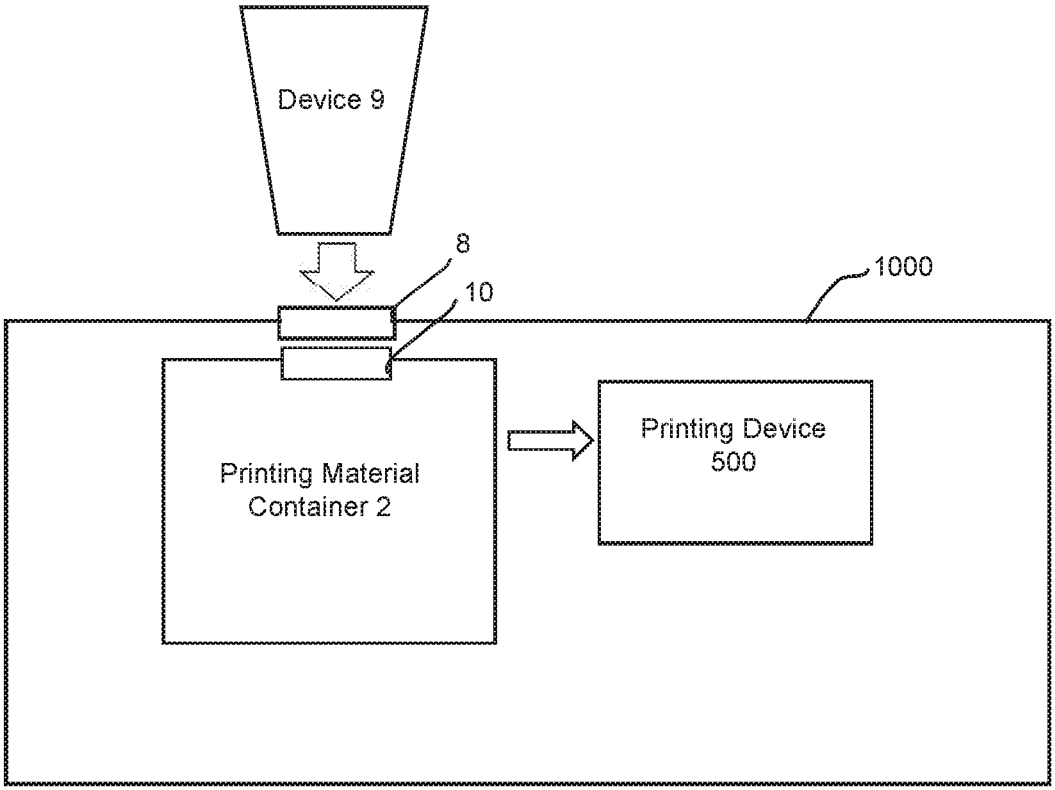
FIG. 1 is a diagram of an example of a printing apparatus.

The printing cartridge may also be refilled with new printing material by using a device to supply printing material as a printing material refill kit.

In this disclosure, when the specification states that one constituent element is "connected to" another constituent element, it includes a case in which the two constituent elements are connected to each other with another constituent element intervened therebetween as well as a case in which the two constituent elements are directly connected to each other. Further, the expression "printing apparatus" as used herein includes an apparatus that processes printing data generated at a terminal such as a computer communicating through a wired connection or wirelessly, which may be a computer for personal and/or business use, a remote server communicating data across a network or the internet, and/or a wireless mobile device such as a smartphone or tablet, to perform printing on or in a medium or in a space. Examples of the printing apparatus may include particulate-based and liquid-based printers and 2D and 3D printing apparatuses. As used herein, the term "and/or" includes any and all combinations of one or more of the associated listed items. Expressions such as "at least one of," when preceding a list of elements, modify the entire list of elements and do not modify the individual elements of the list.

Printing material is material used to print an image or an object using 2D and 3D printing technologies. Different types and forms of materials may be used as printing material. For example, printing material may be in a solid, liquid, colloidal, or gaseous form, or a combination thereof. The printing material may be non-biologic or biologic material, which may be living cells or any other biological compounds. For example, a solid or particulate form of printing material may include printing toner or metallic particulates, and a liquid form of printing material may include liquid-based ink such as ink for ink-jet printing. For example, printing material may be in a liquid form that may be curable to a different form such as a solid.

Reference will now be made in detail to examples, examples of which are illustrated in the accompanying drawings. According to an example, a device to supply printing material to a printing material container fora printing device, which may be as a printing material refill solution/kit, printing material replenishment solution/kit, and/or a printing material refill kit, which is to supply printing material to a printing material container with the printing apparatus such as a printing cartridge installable in and coupleable to a printing apparatus, may be implemented for different types of printing materials, printing cartridges, printing apparatuses and printing principles. According to an example, a device to supply printing material to a development cartridge for an electric charge-based printing is disclosed. However, according to an example, such a device as toner refill solution/kit, toner replenishment solution/kit, and/or a printing material refill kit may be implemented for different types of printing materials, printing principles and printing apparatuses. For example, a device as a printing material refill kit may be implemented for a continuous toner supply.

The printing apparatus 1000 may include some or all of the features described in this disclosure.

According to an example, referring to FIG. 1, the printing apparatus 1000 may include a printing device 500 to perform printing and a printing material container 2 to contain printing material, such as a printing cartridge 2. The printing material in the printing material container 2 may be supplied and/or transported to the printing device 500, such that the printing device 500 may process the supplied/transported printing material to perform printing. The device 9 containing printing material may be coupled to the printing material container 2 to supply printing material in the printing material container 2. The printing material container 2 may be filled, or refilled, or replenished with printing material supplied from the device 9. The printing material container 2 may include a printing material inlet portion 10 or a printing material refilling portion 10 to receive the supplied printing material from the device 9. The device 9 may be coupled directly to the printing material inlet portion 10 or printing material refilling portion 10 to supply printing material, when the printing material container 2 is placed in the printing apparatus 1000 or out of the printing apparatus 1000. According to an example, when the device 9 is coupled to the printing material inlet portion 10 or printing material refilling portion 10, the printing material refilling portion 10 may have some or all of the features of the communication portion 8 or the refill port 8 described in this disclosure, and may function as the communication portion 8 or the refill port 8. The device 9 may be coupled indirectly to the printing material refilling portion 10. For example, the printing apparatus 1000 may include a communication portion 8, and the device may be coupled to the communication portion 8 to supply printing material to the printing material container 2 through the printing material refilling portion 10 connected to the refill port 8. Different types of printing apparatuses and printing principles may be implemented to perform printing using printing material. According to an example, printing device 500 may perform printing, which may include an electric charge-based printing, an ink-jet based printing such as ink-jet printing with a moving nozzle or a static nozzle and high-speed or high-throughput ink-jet printing, printing based on thermal bonding, printing based on chemical bonding, 2D printing, 3D printing, and a combination thereof. Different types of printing apparatuses and materials may include printing apparatuses for personal use, office use, business use, and/or industrial scale and high volume-based printing applications.

Figure 1A:
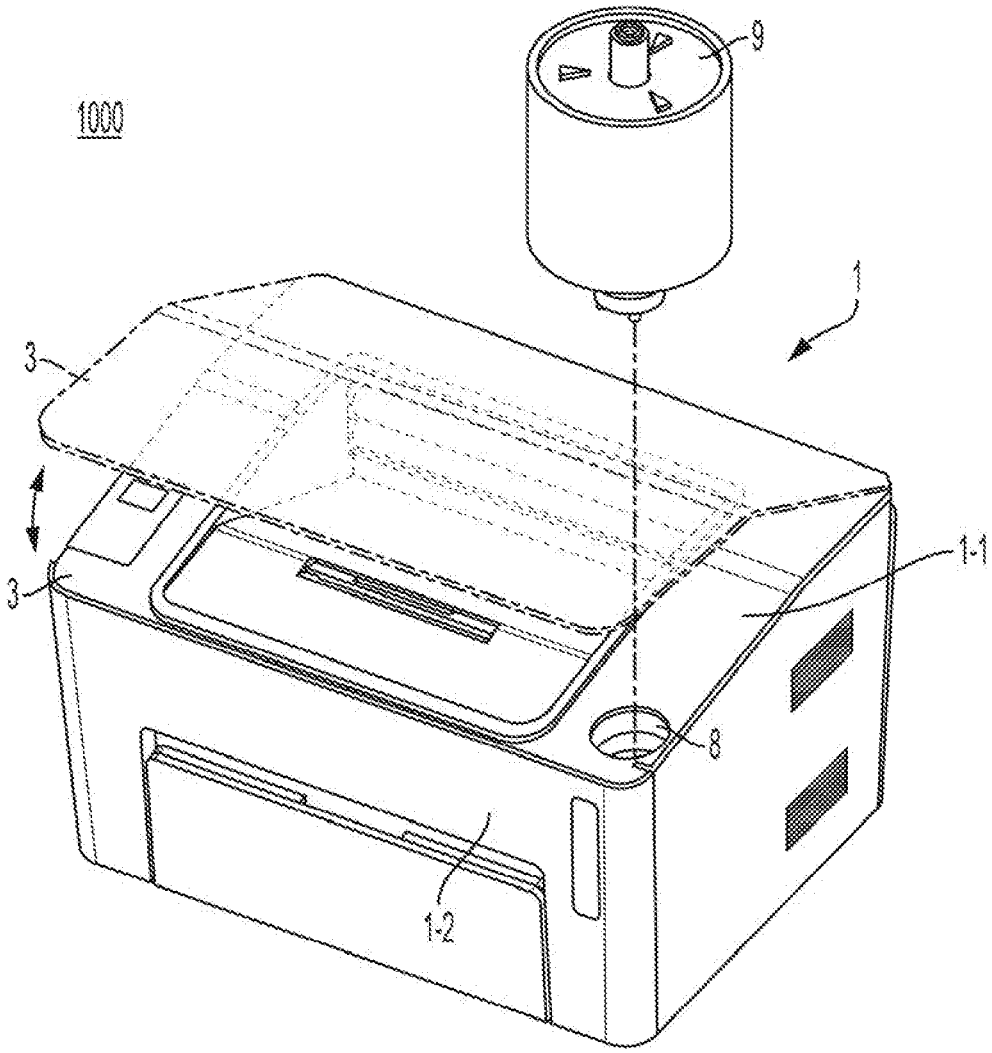
FIG. 1*a* is a perspective view of an example of the exterior of a printing apparatus.

For example, FIG. 1*a* is a perspective view of the exterior of a printing apparatus 1000 according to an example.

Figure 3:
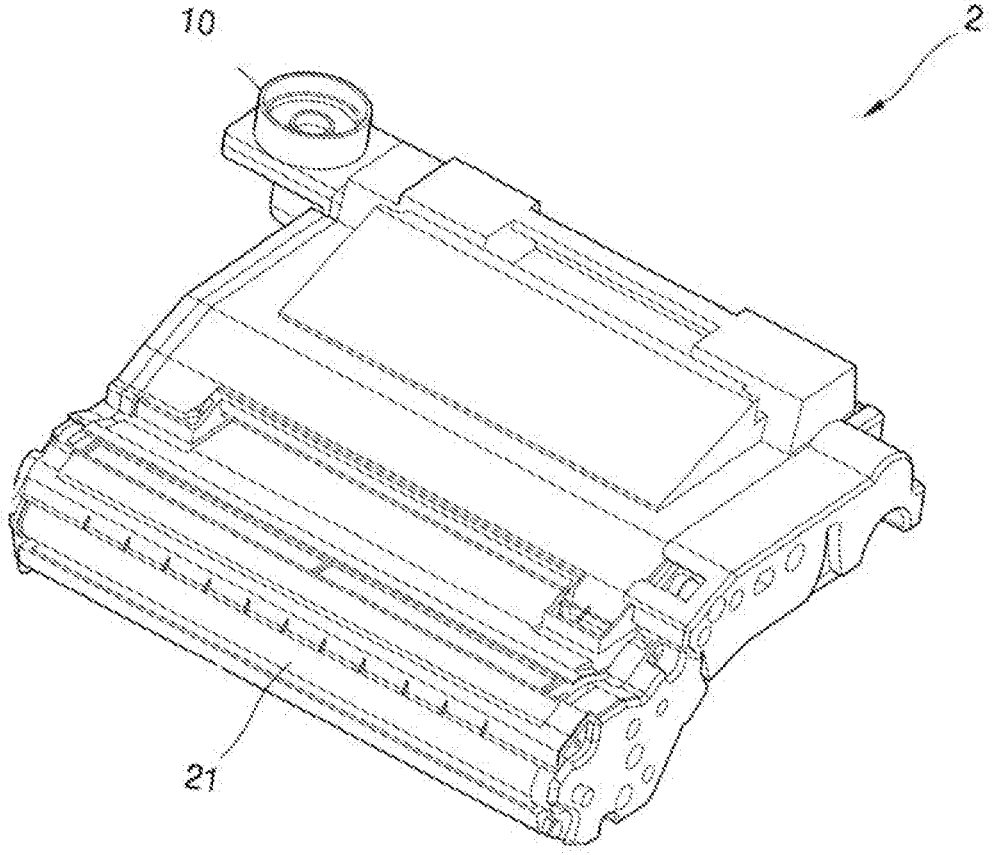
FIG. 3 is a perspective view of a printing material container as a printing cartridge, according to an example.

Referring to FIGS. 1*a*, and 3, the printing apparatus 1000 may include a body 1 and a printing material container 2 as a printing cartridge 2 that is attachable to/detachable from the body 1. A door 3 may be provided in the body 1. The door 3 opens or closes an opening of the body 1 and may cover a portion of the body 1. While the door 3 opening and closing an upper portion of the body 1 is illustrated in FIG. 1*a*, different arrangements of the door 3 may be implemented. For example, a door opening and closing a portion of the body, such as a side portion or a front portion of the body 1, may be included as needed. The printing material container 2 as a printing cartridge may be coupled to or removed from the body 1 through an opening by the door 3.

According to an example, the device 9 may be directly coupleable and/or connectable to the printing material refilling portion 10 of the printing material container 2 as a printing cartridge 2, for example, if the printing material refilling portion 10 is exposed to the outside and accessible directly. According to an example, the printing material container 2 as a printing cartridge 2 may be coupled to the printing apparatus 1000 and enclosed within the body 1 of the printing apparatus 1000. According to an example, the body 1 may include a communication portion 8 to communicate printing material through the body 1. The communication portion 8 may be a form of a refill port 8 through which a printing material refilling portion 10 of the printing material container 2 as a printing cartridge 2 can be accessed from the outside the body 1 while the printing material container 2 as a printing cartridge 2 is coupled to the body 1. According to an example, a refill port 8 may be provided at a position of the body 1, such as a top portion or a side portion of the body 1. For example, the refill port 8 may be provided at a position close to a front surface 1-2 of the body 1. When the front surface 1-2 faces the user, the user may access the refill port 8. A printing material supply or refill operation using a device 9 may be performed through the refill port 8. For example, the refill port 8 may be provided on an upper surface 1-1 of the body 1. When the printing material container 2 as a printing cartridge 2 couples to the printing apparatus 1000, the printing material refilling portion 10 may be provided to be aligned with the refill port 8. For example, the printing material refilling portion 10 may be provided under the refill port 8. According to an example, the refill port 8 and the printing material refilling portion 10 may be aligned with respect to different directions, such as vertical, horizontal or at an angled direction. The device 9 may access the printing material refilling portion 10 from above the body 1 through the refill port 8.

Figure 2A:
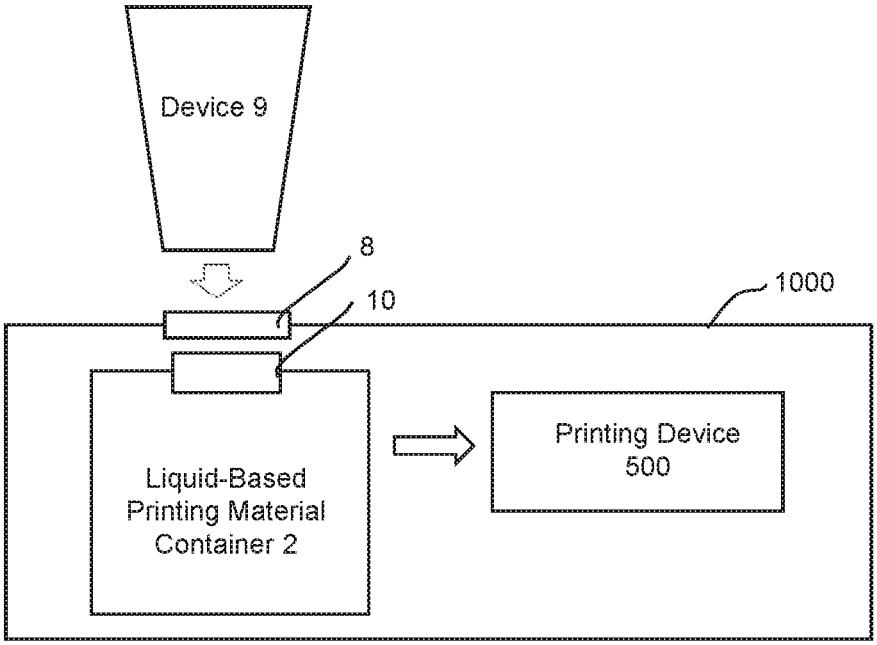
FIG. 2*a* illustrates an example of a printing apparatus.

FIG. 2*a* illustrates an example of a printing apparatus 1000 to perform printing using liquid-based printing material. Referring to FIG. 2*a*, a printing apparatus 1000 to perform printing may include a printing device 500 to selectively deposit liquid-based printing material. The printing device 500 may include a variety of different suitable liquid application systems, such as ink-jet based system, which may include a thermal printing system which involves use of heat for achieving the ejection of liquid-based printing material. According to another example, the printing device 500 may include a charge controlled printing system in which electrostatic attraction is used for ejecting liquid-based printing material. As another example, the printing device 500 may include a printing system that can use vibration pressure generated by a piezoelectric element for ejecting liquid-based printing material. For example, the printing device 500 may adopt an acoustic technique for the ejection of liquid-based printing material. In the acoustic technique, an electric signal is transformed into an acoustic beam and the compositions are irradiated by the acoustic beam so as to be ejected by radiation pressure.

According an example, a variety of different suitable liquid-based printing material application systems as the printing device 500 may include liquid-based printing material application systems employing those that are stationary during printing and span to form a printing zone, or a reciprocating printhead or nozzle, which, for diagrammatic purposes, may also be illustrated by the printing device 500.

According to an example, the printing device 500 may be implemented using one or any combination of the above mentioned examples of different suitable liquid-based printing material application systems.

Figure 2B:
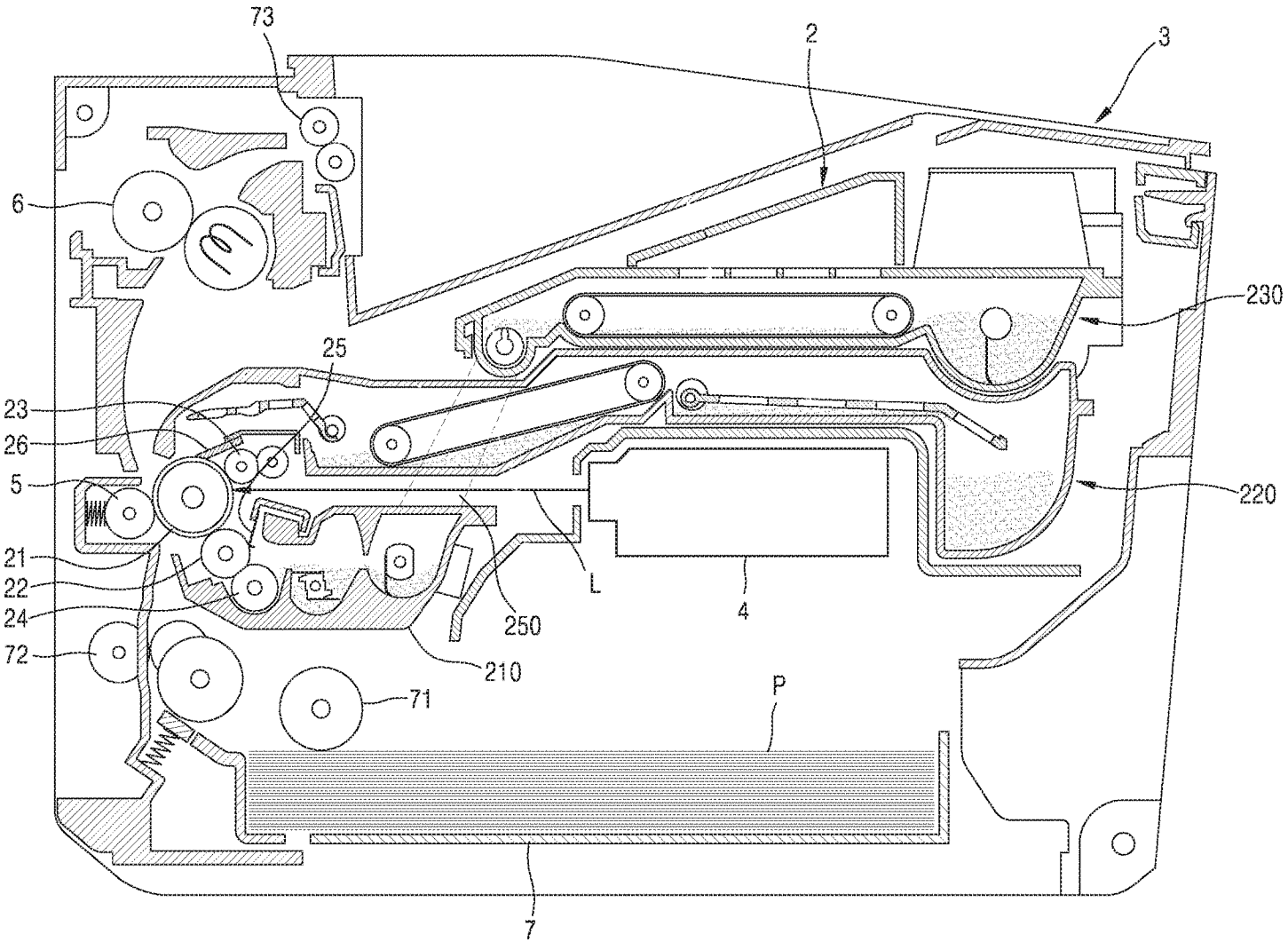
FIG. 2*b* is a structural diagram of an example of a printing apparatus.

FIG. 2*b* illustrates an example of a printing apparatus 1000 for an electric charge-based printing. Referring to FIG. 2*b*, a photosensitive drum 21 is an example of a photoconductor on which an electrostatic latent image is to be formed. For example, the photosensitive drum may include a cylindrical drum and a photoconductive photosensitive layer formed on an outer circumference of the drum. A charging roller 23 is an example of a component or material that charges a surface of the photosensitive drum 21 to have a uniform electric potential. A charge bias voltage may be applied to the charging roller 23. Instead of the charging roller 23, a corona charger (not shown) may be used. A developing roller 22 supplies printing material to an electrostatic latent image formed on a surface of the photosensitive drum 21 with beams or radiation of power or light to develop the electrostatic latent image.

According to an example, a two-component developing method may be used, in which printing material and a carrier are used as a developer. A carrier, which may be a substance that has specific magnetic or electrical properties, is commonly formed as spheres or hedrons or other geodesic shape that serve to be attracted to a magnetized substance and stack one upon another until the magnetic attraction to the magnetized substance is too weak to attract another carrier. The carrier may natively have an attractive property to print materials and serve to "carry" or collect and transfer the print material from one place to the electrostatically produced latent image where the print material is released from the carrier and temporarily attached to latent image until transferred to its intended substrate.

The developing roller 22 may be in the form of a sleeve inside of which a magnet is fixed. The sleeve may be located apart from the photosensitive drum 21 by tens to hundreds of micrometers. The carrier is attached to an outer circumference of the developing roller 22 via a magnetic force of a magnet, and printing material is attached to the carrier via an electrostatic force, which may form a form of a magnetic brush including the carrier and printing material on the outer circumference of the developing roller 22. According to a developing bias applied to the developing roller 22, only printing material is moved to the electrostatic latent image formed on the photosensitive drum 21.

In a one-component developing method in which printing material is used as a developer, the developing roller 22 may be in contact with the photosensitive drum 21, and may be located apart from the photosensitive drum 21 by a small measure, such as tens to hundreds of micrometers. In the example, a one-component contact developing method in which the developing roller 22 and the photosensitive drum 21 contacts each other to form a developing nip is used. The developing roller 22 may be in the form of an elastic layer (not shown) formed on an outer circumference of a conductive metal core (not shown). When a developing bias voltage is applied to the developing roller 22, printing material is moved via the developing nip, to the electrostatic latent image formed on a surface of the photosensitive drum 21 to be attached to the electrostatic latent image.

A supplying roller 24 attaches printing material to the developing roller 22. A supply bias voltage may be applied to the supplying roller 24 to attach printing material to the developing roller 22. A regulating member 25 regulating a printing material amount may be provided to be attached to the surface of the developing roller 22. The regulating member 25 may be, for example, a regulating blade having a front end that contacts the developing roller 22 at a certain pressure. A cleaning member 26 may be provided to remove residual printing material and foreign substances from the surface of the photosensitive drum 21 before charging. The cleaning member 26 may be, for example, a cleaning blade having a front end that contacts the surface of the photosensitive drum 21 at a certain pressure. Hereinafter, foreign substances removed from the surface of the photosensitive drum 21 will be referred to as waste printing material.

An optical projector 4 may be provided to project light modulated according to image information, onto a surface of the photosensitive drum 21 charged to a uniform electric potential. As the optical projector 4, for example, a laser unit that projects light radiated from a laser diode onto the photosensitive drum 21 by deflecting the light by using a polygon mirror, in the main scanning direction, may be used.

A transfer roller 5 is an example of a transfer unit that is located to face the photosensitive drum 21 to form a transfer nip. A transfer bias voltage used to transfer a printing material image developed on the surface of the photosensitive drum 21 to a print medium P is applied to the transfer roller 5. Instead of the transfer roller 5, a corona transfer unit may be used.

The printing material image transferred to a surface of the print medium P via the transfer roller 5 is maintained on the surface of the print medium P due to an attractive electrostatic force. A fusing or fixing unit 6 fuses the printing material image on the print medium P by applying heat and pressure to the printing material image, thereby forming a permanent print image on the print medium P.

Referring to FIGS. 2*b* and 3, the printing material container 2 as a printing cartridge 2 according to the example includes a developing portion 210 in which the photosensitive drum 21 and the developing roller 22 are mounted, a waste container 220 receiving waste printing material removed from the photosensitive drum 21, and a printing material containing portion 230 connected to the developing portion 210 and containing printing material. In order to refill printing material in the printing material containing portion 230, the printing material container 2 as a printing cartridge 2 includes a printing material refilling portion 10 connected to the printing material containing portion 230. The printing material refilling portion 10 provides an interface with respect to the printing material container 2 as a printing cartridge 2. According to an example, the printing material container 2 as a printing cartridge 2 may be an integrated type printing cartridge including the developing portion 210, the waste container 220, the printing material containing portion 230, and the printing material refilling portion 10.

A portion of an outer circumference of the photosensitive drum 21 is exposed outside a housing. A transfer nip is formed as the transfer roller 5 contacts an exposed portion of the photosensitive drum 21. At least one conveying member conveying printing material towards the developing roller 22 may be installed in the developing portion 210. The conveying member may also perform a function of charging printing material to a certain electric potential by agitating the printing material.

The waste container 220 may be located above the developing portion 210. The waste container 220 is spaced apart from the developing portion 210 in an upward direction to form a light path 250 therebetween. Waste printing material removed from the photosensitive drum 21 by using the cleaning member 26 is received in the waste container 220. The waste printing material removed from the surface of the photosensitive drum 21 is fed into the waste container 220. The shape and number of waste printing material feeding members are not limited. An appropriate number of waste printing material feeding members may be installed at appropriate locations to distribute waste printing material effectively in the waste container 220 by considering a volume or shape of the waste container 220.

The printing material containing portion 230 is connected to the printing material refilling portion 10 to receive printing material. The printing material containing portion 230 may be connected to the developing portion.

According to an example, a material supplying member may be used to supply printing material to the developing portion 210 from the printing material containing portion 230.

Referring to FIG. 2*b*, a charge bias is applied to the charging roller 23, and the photosensitive drum 21 is charged to a uniform electric potential. The optical projector 4 projects light modulated in accordance with image information, onto the photosensitive drum 21, thereby forming an electrostatic latent image on a surface of the photosensitive drum 21. The supplying roller 24 supplies printing material to a surface of the developing roller 22. The regulating member 25 may be provided to help to form a printing material layer having a uniform thickness on the surface of the developing roller 22. A developing bias voltage is applied to the developing roller 22. As the developing roller 22 is rotated, printing material conveyed to a developing nip is moved and adhered to the electrostatic latent image formed on the surface of the photosensitive drum 21 via the developing bias voltage, thereby forming a visible printing material image with the adhered printing material on the surface of the photosensitive drum 21. The print medium P may be withdrawn from a loading tray 7 by a pickup roller 71, transported and fed by a feeding roller 72 to the transfer nip where the transfer roller 5 and the photosensitive drum 21 face each other. When a transfer bias voltage is applied to the transfer roller 5, the adhered printing material in a form of the printing material image is transferred to the print medium P via an attractive electrostatic force. As the printing material image transferred to the print medium P receives heat and pressure from the fusing unit 6, the printing material image is fused to the print medium P. The print medium P may be discharged by using a discharge roller 73. The printing material that is not transferred to the print medium P but remains on the surface of the photosensitive drum 21 may be removed by using the cleaning member 26.

As described above, according to an example, referring to FIG. 2*b*, the printing material container 2 as a printing cartridge 2 supplies the printing material contained in the printing material containing portion 230 to the electrostatic latent image formed on the photosensitive drum 21 to form a visible printing material image, and is attachable to/detachable from the body 1. In addition, the printing material container 2 as a printing cartridge 2 includes the printing material refilling portion 10 used to refill printing material. The printing material refilling portion 10 may be integrated with the printing material container 2 as a printing cartridge 2 and thus may be exposed to the outside for accessibility or attachable to/detachable from the body 1 together with the printing material container 2 as a printing cartridge 2. According to the printing apparatus 1000 of the example, without removing the printing material container 2 as a printing cartridge 2 from the body 1, printing material may be refilled in the printing material container 2 while the printing material container 2 is mounted in the body 1. as printing material is refilled in the printing material containing portion 230 by using the printing material refilling portion 10, a replacement time of the printing material container 2 as a printing cartridge 2 may be extended, for example, until the lifetime of the photosensitive drum 21 ends, thereby reducing printing costs. In addition, printing material may be refilled while the printing material container 2 as a printing cartridge 2 is mounted in the body 1.

Referring to FIG. 3, according to an example, the printing material container 2 as a printing cartridge 2 may be an integration-type printing cartridge 2 in which the printing material refilling portion 10 is integrated, as illustrated in FIG. 3. The printing material container 2 as a printing cartridge 2 may be distributed during the product distribution stage while being mounted in the body 1. The printing material container 2 as a printing cartridge 2 may be a consumable item that is replaceable and is to be replaced when the life of the printing material container 2 as a printing cartridge 2 ends, and may be distributed separately from the body 1.

The printing material container 2 such as a printing cartridge 2 and the device 9 may be consumables removable from the printing apparatus 1000, and the printing material refilling portion 10 in the printing material container 2 such as a printing cartridge 2 may utilize the same interface as that of the printing material container 2 to connect the printing material container 2 and the device 9 to the body 1 of the printing apparatus 1000.

The printing apparatus 1000 may include the body 1, the printing material container 2 such as a printing cartridge 2 removable from the body 1, the printing material refilling portion 10 in the printing material container 2 such as a printing cartridge 2, and the controller 300. The printing material container 2 such as a printing cartridge 2 supplies printing material accommodated in the printing material containing portion 230 to an electrostatic latent image formed on a photoconductor to form a printing material image, the printing material container 2 such as a printing cartridge 2 being removable from the body 1. The printing material refilling portion 10 may be in the printing material container 2 such as a printing cartridge 2, and the device 9 for refilling printing material in the printing material containing portion 230 may be coupled to the printing material refilling portion 10. The controller 300 may control operations of the printing apparatus 1000 based on a connection between the printing material container 2 coupled to the body 1 and the device 9 coupled to the printing material refilling portion 10. The printing material refilling portion 10 may connect the device 9 coupled to the printing material refilling portion 10 to the body 1 through the interface between the printing material container 2 and the body 1. The printing material refilling portion 10 may be formed integrally with the printing material container 2.

According to an example, the device 9 may be coupled to the printing material refilling portion 10 through the refill port 8 from the outer surface of the body 1 of the printing apparatus 1000 when the device 9 is inserted into the refill port 8 from above the body 1, the device 9 may be coupled to the printing material refilling portion 10 as shown in FIG. 3. When the plunger 93 of the device 9 moves in the direction A of the container 91 toward the portal 940 in a state in which the device 9 is coupled to the printing material refilling portion 10, printing material accommodated in the container 91 may be discharged through a portal 940 such as a plug 940 or a port assembly 940 and supplied to the printing material containing portion 230 of the printing material container 2 through the printing material refilling portion 10. The device 9 may be removed from the refill port 8 after completion of the printing material transfer.

Figure 4:
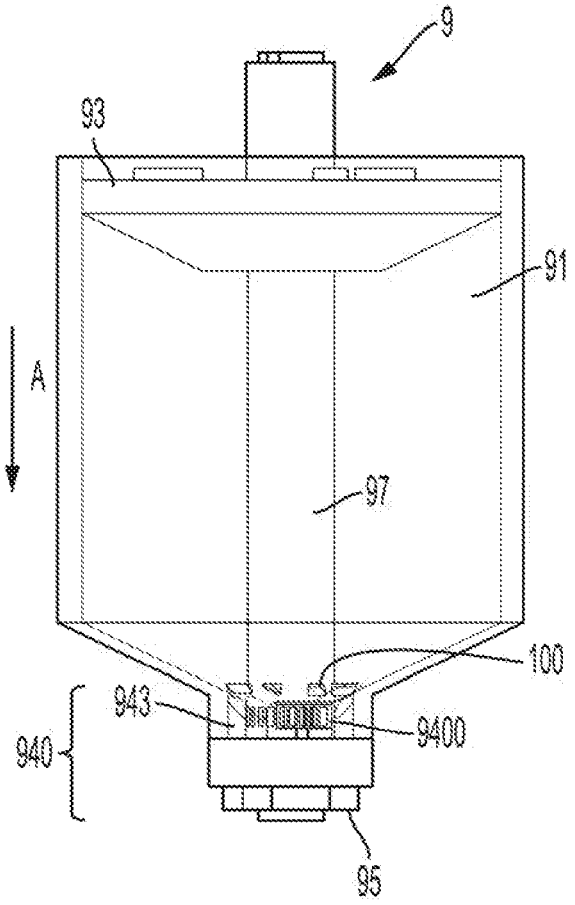
FIG. 4 is a structural diagram of a device according to an example.

FIG. 4 is a structural diagram of the device, which is a perspective view of an example of the device. The term "refill" is used for convenience in understanding the disclosure, and the term "refill" is not limited to a refill operation but to be construed as a printing material supply operation.

Figure 5B:
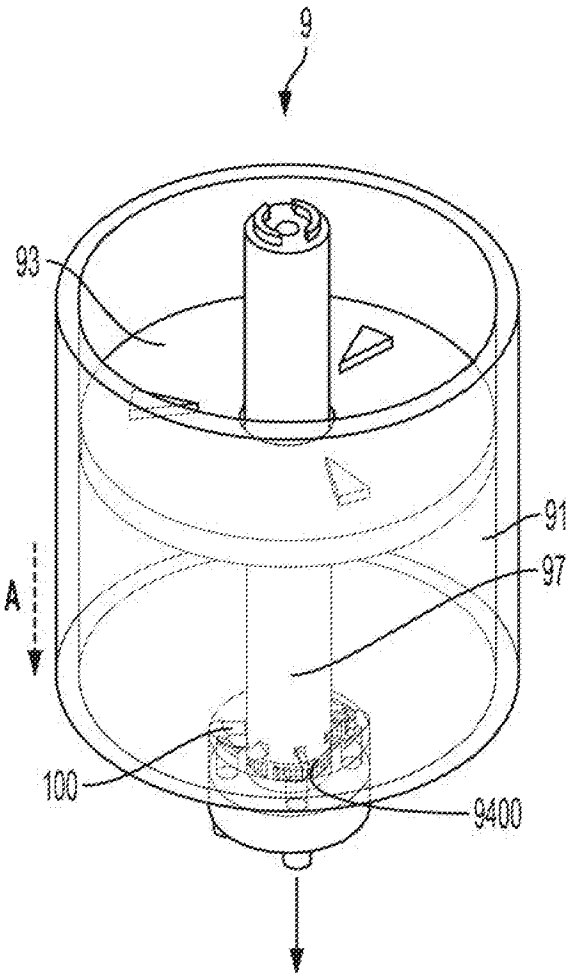
FIGS. 5*a* and 5*b* are diagrams of operation of the device according to an example.
Figure 5A:
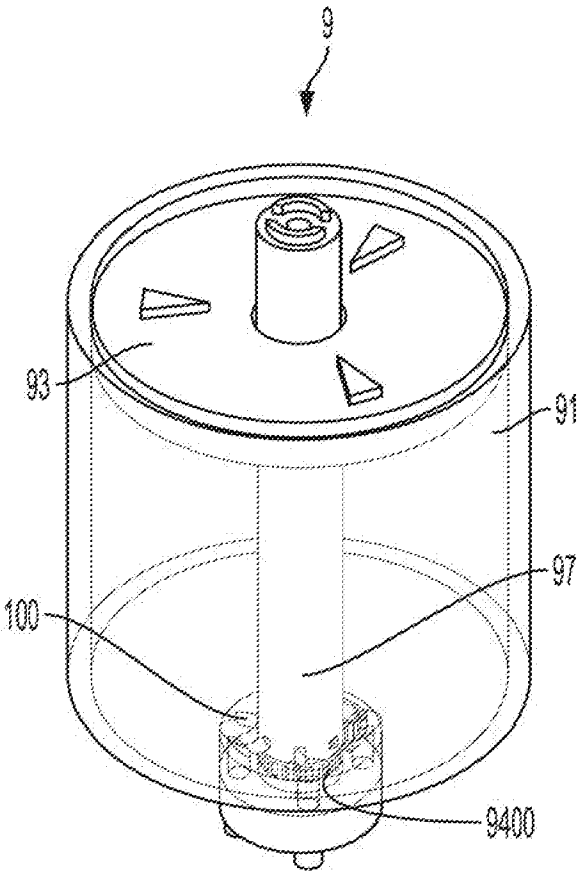

FIGS. 5*a* and 5*b* are diagrams of operation of the device according to an example.

According to an example, referring to FIG. 4, A device 9 to supply printing material to a printing material container 2 of a printing apparatus 1000 may include a container 91 including a plunger 93 and to contain the printing material, a portal 940 couplable to a refill port 10 to the printing material container 2. The portal 940 may include a discharge port 943 through which the printing material is transferrable from the container 91, and a connector 9400 to receive power to move the plunger 93, to cause a transfer of the printing material contained in the container 91 to the printing material container 2 through the discharge port 943. According to an example, referring to FIG. 4, a device 9 to refill a printing material container 2 such as a printing cartridge of a printing apparatus 1000 with printing material may include a container 91 including a plunger 93 and to contain the printing material, a portal 940 couplable to a refill port 10 of the printing material container 2, and to couple to the container 91 with the printing material container 2. The portal 940 may include a discharge port 943 through which the printing material is transferrable from the container 91, and a connector 9400 to receive power to move the plunger 93, to cause a transfer of the printing material contained in the container 91 to the printing material container 2 through the discharge port 943. According to an example, referring to FIG. 4, the device 9 may include a hollow body 91 as a printing material chamber 91 and as a container 91 to accommodate printing material and a portal 940 that is couplable to the printing material refilling portion 10 of the printing material container 2, to discharge or transfer printing material accommodated in the container 91 through the portal 940, and to supply printing material from the device 9 to the printing material container 2 such as a printing cartridge 2. The portal 940 may be coupled to the printing material refilling portion 10 through the refill port 8. According to an example, the container 91 may be in a form of a hopper 91. For example, the container 91 may have a portion where its cross-sectional area with respect to the portal 940 decreases toward the portal 940, to merge a flow of printing material toward the portal 940. According to an example, the device 9 may include a plunger 93 which is movable in the container 91. The plunger 93 may be movable to plunge printing material contained in the container 91, to discharge or transfer the printing material through the portal 940. According to an example, the plunger 93 may move to force the printing material to be discharged through the portal 940, for example, a discharge port 943 included in the portal 940. For example, referring to FIGS. 5*a* and 5*b*, the plunger 93 may be movable in the direction A toward the portal 940, to push and plunge printing material out of the container 91 through the portal 940. The portal 940 may be provided at a tip portion of the container 91.

According to an example, referring to FIGS. 1, 3, and 4, the printing apparatus 1000 to include a printing material container 2 such as a printing cartridge coupleable to a device 9 may comprise a refill port 8 through which the device 9 including printing material is couplable to the printing material container 2 and to receive power to drive the device 9 to supply the printing material included in the device 9 to the printing material container 2. For example, the refill port 8 includes a power transference medium 901 through which the device 9 is to receive the power to drive the device 9.

According to an example, the device 9 may include a shaft 97. A shaft 97 may be rotatably disposed and may be coupled to the plunger 93. For example, a shaft 97 may be rotatable to move the plunger 93 toward the discharge port 943, to cause the transfer of the printing material. For example, referring to FIG. 4, the device 9 may comprise a shaft 9 rotatable to move the plunger 93 toward the discharge port 943, to cause the transfer of the printing material. According to an example, the plunger 93 may move along the shaft 97 to plunge printing material contained in the container 91. According to an example, referring to FIGS. 4, 5*a* and 5*b*, the shaft 97 may be disposed through the container 91 parallel to the direction A, and the plunger 93 may move along the shaft 97 and in the direction A. For example, the plunger 93 may be movable by a rotation of the shaft 97.

Figure 5D:
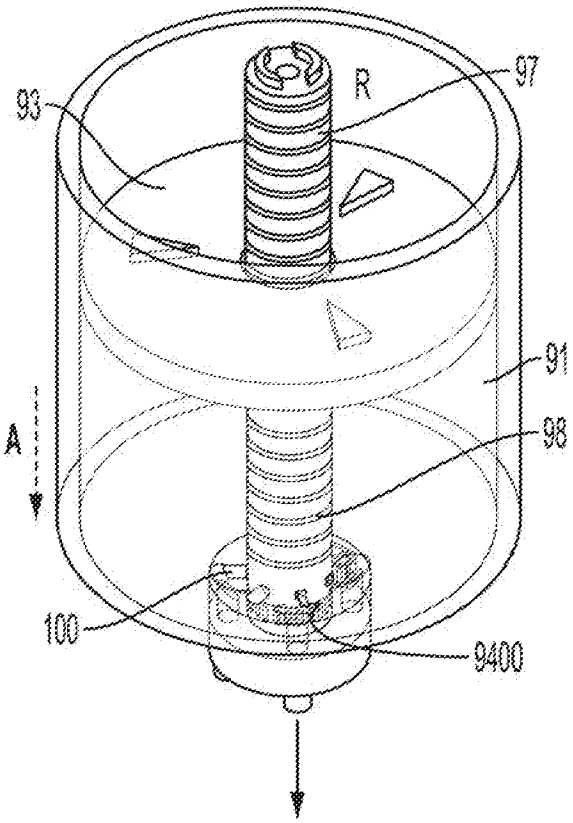
FIGS. 5*c* and 5*d* are diagrams of operation of the device having a threaded portion according to an example.
Figure 5C:
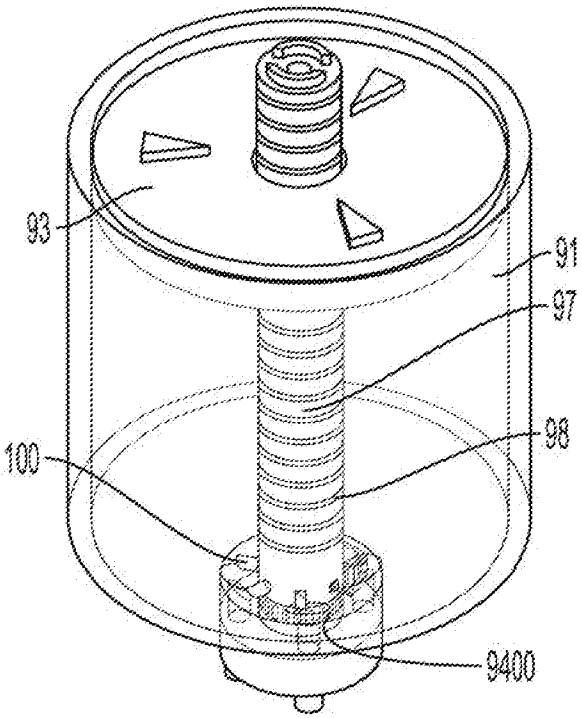

According to an example, referring to FIGS. 5*c* and 5*d*, the shaft 97 may include an engaging portion 98 to engage the plunger 93, such as a threaded portion 98, a thread 98 or a variety of possible structure for such engagement, and the plunger 93 may be to engage with the engaging portion 98 such as the threaded portion 98 to be movable by rotating of the shaft 97 along the threaded portion 98, to cause the transfer of the printing material. For example, the shaft 97 may include an engaging portion 98 to engage the plunger 93, and the plunger 93 may be to engage with the engaging portion 98 to be movable by rotating of the shaft 97 along the engaging portion 98, to cause the transfer of the printing material. For example, referring to FIGS. 5*c* and 5*d*, the shaft 97 may include a threaded portion 98, and the plunger 93 may rotate along the threaded portion 98 to move along the shaft 97 in the direction A by the rotation R of the shaft 97. When the plunger 93 of the device 9 is moved in the direction A of the container 91 in a state the device 9 is coupled to the printing material refilling portion 10, printing material accommodated in the container 91 is discharged through the portal 940 and supplied to the printing material containing portion 230 of the printing material container 2 through the printing material refilling portion 10.

According to an example, the plunger 93 may be movable by a manual operation or by power received from a power supply 400. For example, the shaft 97 may be manually rotated or may be rotated by power received from a power supply 400. According to an example, different forms of power may drive the device 9. For example, forms of power may include mechanical power or electrical power. According to an example, in an example of electrical power, the device 9 may include an electrical actuator, such as an electrical motor, to move the plunger 93 or to rotate the shaft 97. According to an example, a power supply 400 may be included in the device 9, the printing apparatus 1000 or printing cartridge 2. According to an example, a power supply 400 may be a separate power supply 400 directly or indirectly couplable to the device 9, the printing apparatus 1000 or the printing material container 2. For example, referring to FIGS. 8*a* through 8*c*, the printing apparatus 1000 may include a power supply 400 to supply power to the device 9 through the power outlet 901 to drive the device 9 to supply printing material to the printing material container 2.

According to an example, the device 9 may include a sifting flange 100 that is rotatable along with the shaft 97 to push down printing material toward the discharge port 943 and to reduce compaction of the printing material that is flowing into the discharge port 943. According to an example, referring to FIGS. 4 and 6, the shaft 97 may include a sifting flange 100 disposed adjacent to the discharge port 943, the sifting flange 100 to rotate along with the shaft 97 to sift printing material toward the discharge port 943. The device 9 may include a plurality of sifting flanges 100. The sifting flange 100 may be attached to the shaft 97 to rotate along with the shaft 97. The sifting flange 100 may be made of material that does not collect a static charge, such that effects and interferences from such a static to printing material is suppressed. Geometrical dimensions of the sifting flange may be determined to more efficiently push printing material toward the discharge port 943 and in consideration of the durability. For example, the length of the sifting flange 100 may be long enough to sufficiently push printing material toward the discharge port 943 while the maximum length may be determined to reduce the stress to the sifting flange 100. According to an example, the sifting flange 100 may be angled with respect to a horizontal plane and/or a vertical plane. According to an example, the sifting plane may have a round edge.

Figure 6:
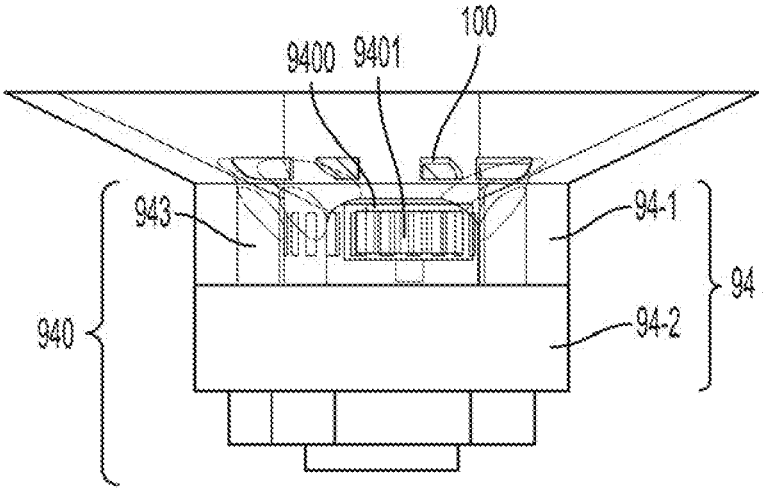
FIG. 6 is a structural diagram of a portal of the device according to an example.

FIG. 6 is a structural diagram of the portal 940 of the device 9 according to an example. The portal 940 may be coupled to the container 91 or integrated with the container 91 as a part of the container 91. According to an example, the portal 940 may be disposed adjacent to a connector 9400 to receive power. According to an example, the portal 940 may include a connector 9400. For example, referring to FIGS. 4 and 6, the device 9 may include the portal 940 couplable to the refill port 8 of the printing material container 2, and to couple the container 91 with the printing material container 2 such as a printing cartridge 2. For example, the portal 940 may include a discharge port 943 through which the printing material is transferrable from the container 91. The portal 940 may include a connector 9400 to receive power to move the plunger 93, to cause a transfer of the printing material contained in the container 91 to the printing material container 2 through the discharge port 943. Through the connector 9400, power may be supplied to drive the device 9 to discharge printing material. According to an example, the connector 9100 may include a first power transfer medium 9401 to receive power to drive the device 9. According to an example, the refill port 8 may include a power outlet 901 through which power is supplied to drive the device 9. For example, referring to FIG. 9, the refill port 8 may include a power outlet 901 through which the device 9 is to receive the power to drive the device 9. For example, referring to FIG. 9, the refill port 8 includes a power outlet 901, a power transference medium 901, a power take-off solution 910, or transference solution 901, through which the device 9 is connected to a power supply 400, to receive power to drive the device 9. According to an example, the refill port 8 may include printing material inlet 902 to be connected to the portal 940 to receive printing material.

According to an example, the portal 940 may include a discharge port 943 through which the printing material is transferrable from the container 91. According to an example, referring to FIGS. 6 and 7*a*-7*d*, the portal 940 may include a plurality of discharge ports 943. According to an example, when printing material is transferred out of the container 91 and discharged through the portal 940, printing material may be discharged through the discharge port 943 included in the portal 940. According to an example, when the portal 940 couples to the refill port 8 and aligned to discharge printing material through the portal 940, the discharge port 943 may connect to the printing material inlet 902 in the refill port 8, to transfer the printing material discharged through the discharge port 943 through the printing material inlet 902, and to the printing material container 2.

According to an example, the device 9 may include a locking structure 94 provided to selectively open and close the portal 940, for example, by selectively forming the discharge port 943, or by selectively blocking and unblocking the discharge port 943, to allow containment of printing material in the device 9 until the device 9 is interfaced with the printing cartridge for transferring printing material from the container 91 to the printing material container 2. For example, referring to FIG. 4, the locking structure 94 may include a discharge shutter 95 provided to selectively open and close the portal 940, by selectively opening and closing the discharge port 943. According to an example, the discharge shutter 95 may be provided at a location with respect to the portal 940. For example, the discharge shutter 95 may be provided inside the container 91, to selectively close and open the discharge port 943. For example, the discharge shutter 95 may be provided outside of the container 91 to close and open the portal from outside. For example, the discharge shutter 95 may be provided at the external side of discharge port 943.

Figure 7A:
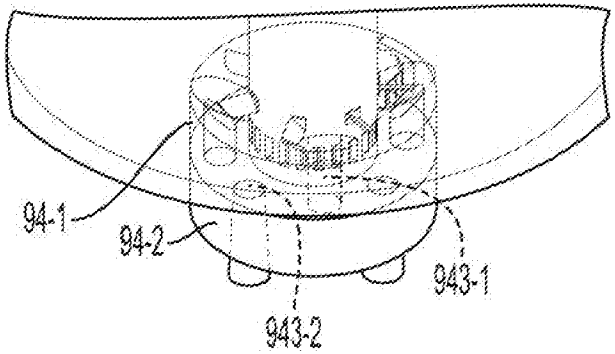
FIGS. 7*a* through 7*d* illustrate an example of a locking structure of the device.
Figure 7B:
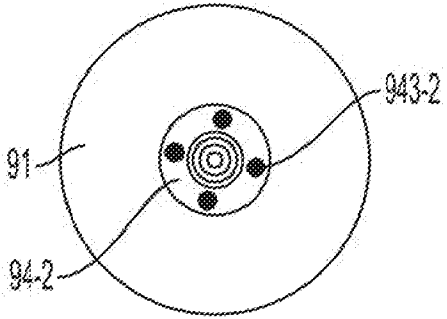
Figure 7C:
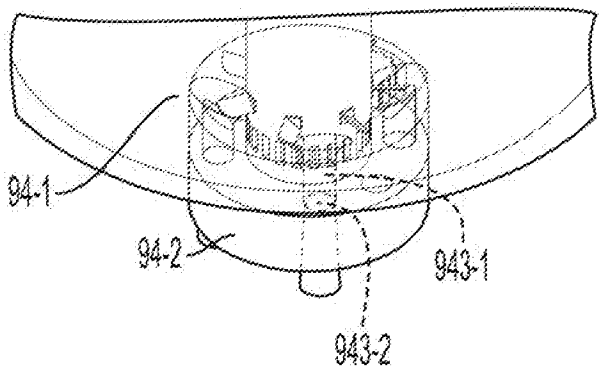
Figure 7D:
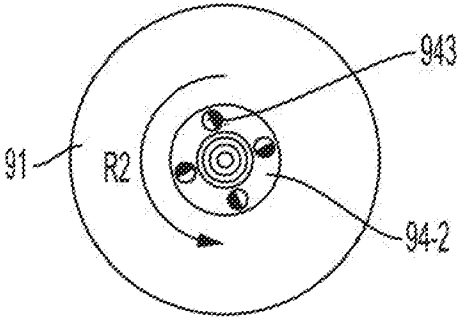

According to an example, the locking structure 94 may have a first locking piece 94-1 having a first hole as a first portion 943-1 of discharge port 943 and a second locking piece 94-2 having a second hole as a second portion 943-2 of discharge port 943. According to an example, the first portion 943-1 and the second portion 943-2 may be aligned to form the discharge port 943. The first portion 943-1 and the second portion 943-2 may be unaligned or aligned to form the discharge port 943 selectively. FIGS. 7*a* through 7*d* illustrate an example of a locking structure. For example, referring to 7A through 7*d*, the device 9 may comprise a locking structure including a first locking piece 94-1 having a first portion 943-1 of the discharge port 943, and a second locking piece 94-2 having a second portion 943-2 of the discharge port 943, wherein at least one among the first locking piece 94-1 and the second locking piece 94-2 is movable to connect the first portion 943-1 and the second portion 943-2 to form an opening of the discharge port 943 and to disconnect the first portion 943-1 and the second portion 943-2 to close the opening of the discharge port 943. According to an example, at least one of the first portion 943-1 and the second portion 943-2 are movable to be in different alignments of each other. According to an example, the locking structure 94 may include a first locking piece 94-1 having a first portion 943-1 of the discharge port 943 and a second locking piece 94-2 having a second portion 943-2 of the discharge port 943. According to an example, at least one among the first locking piece 94-1 and the second locking piece 94-2 may be movable to connect the first portion 943-1 and the second portion 943-2 to form an opening of the discharge port 943 and movable to disconnect the first portion 943-1 and the second portion 943-2 to close the discharge port 943. According to an example, referring to FIGS. 7*a* and 7*b*, when the first portion 943-1 of discharge port 943 at the first locking piece 94-1 and the second portion 943-2 of discharge port 943 at the second locking piece 94-2 are unaligned and disconnected at a first alignment of the first and second portions 943-1 and 943-2, the discharge port 943 is unaligned, and hence closed and unformed, such that the locking structure 94 allows printing material to stay in the container 91. Referring to FIGS. 7*c* and 7*d*, after the rotation R2, when the first portion 943-1 of discharge port 943 at the first locking piece 94-1 and the second portion 943-2 of discharge port 943 at the second piece are aligned and connected at a second position of the mechanism, the discharge port 943 is formed to be open, such that printing material in the container 91 may be allowed to be discharged through the discharge port 943. After the rotation R2, the device 9 may be aligned to connect to the printing material container 2, and the discharge port 943 is formed to be open, such that printing material in the container 91 may be allowed to be discharged through the discharge port 943 to the printing material container 2.

According to an example, the power supply 400 may supply power through the refill port 8 of the printing apparatus 1000. A variety of power transferring mechanism may be implemented to transfer power. For example, the power transferring mechanism may include a Dog, Friction-clutch, Pressure-clutch, and other types of clutch to transfer power to move the plunger 93 as the piston 93.

Figure 8A:
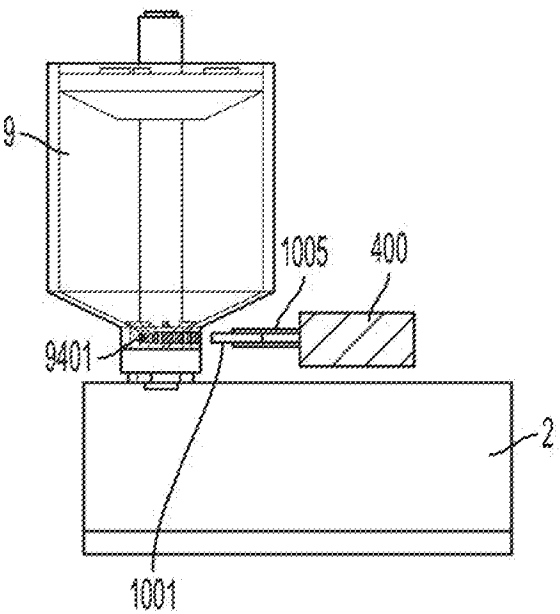
FIGS. 8*a* through 8*c* show an example process of a power supply.
Figure 8B:
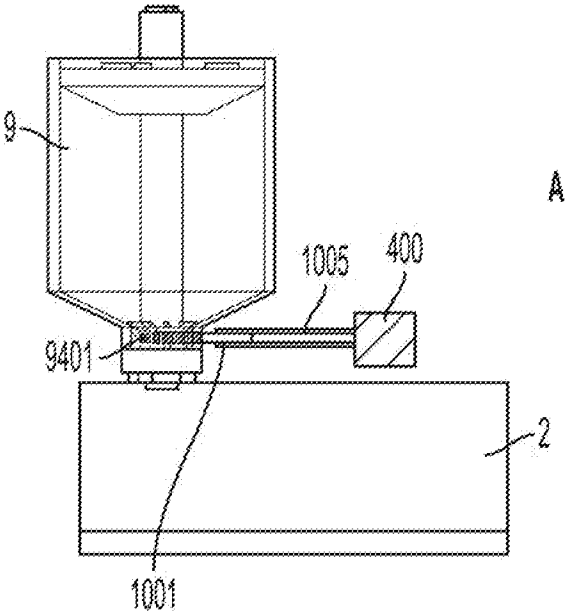
Figure 8C:
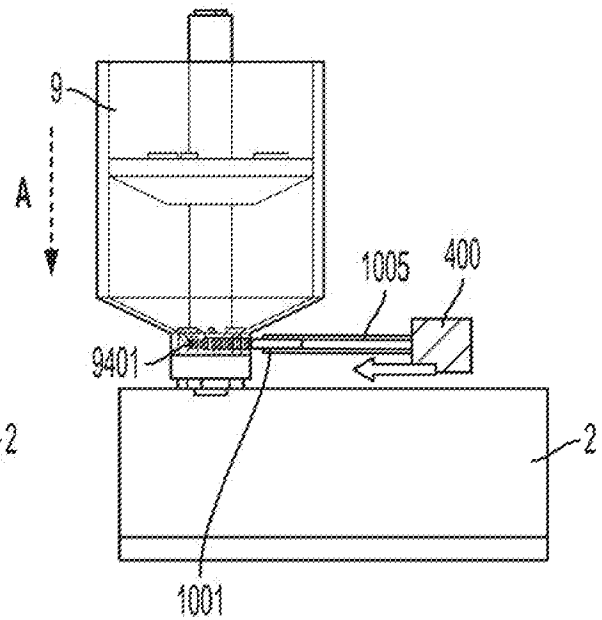

According to an example, the connector 9400 may include a first power transfer medium 9401 to receive power to drive the device 9. The refill port 8 may include a second power transfer medium 1001 to receive power from the power supply 400 and couple to the first power transfer medium 9401 to transfer power from the power supply 400. FIGS. 8*a* through 8*c* shows an example process of power supply 400. According to an example, referring to FIGS. 8*a* through 8*c*, the second power transfer medium 1001 couples to the extension shaft 1005. According to an example, referring FIG. 8*a*, the second power transfer medium 1001 may couple to the extension shaft 1005 and separated from the first power transfer medium 9401. Referring to FIG. 8*b*, the extension shaft 1005 may move the second power transfer medium 1001 to couple to the first power transfer medium 9401. Referring to FIG. 8*c*, the extension shaft 1005 may move the second power transfer medium 1001 to be separated from the first power transfer medium 9401.

Figure 9:
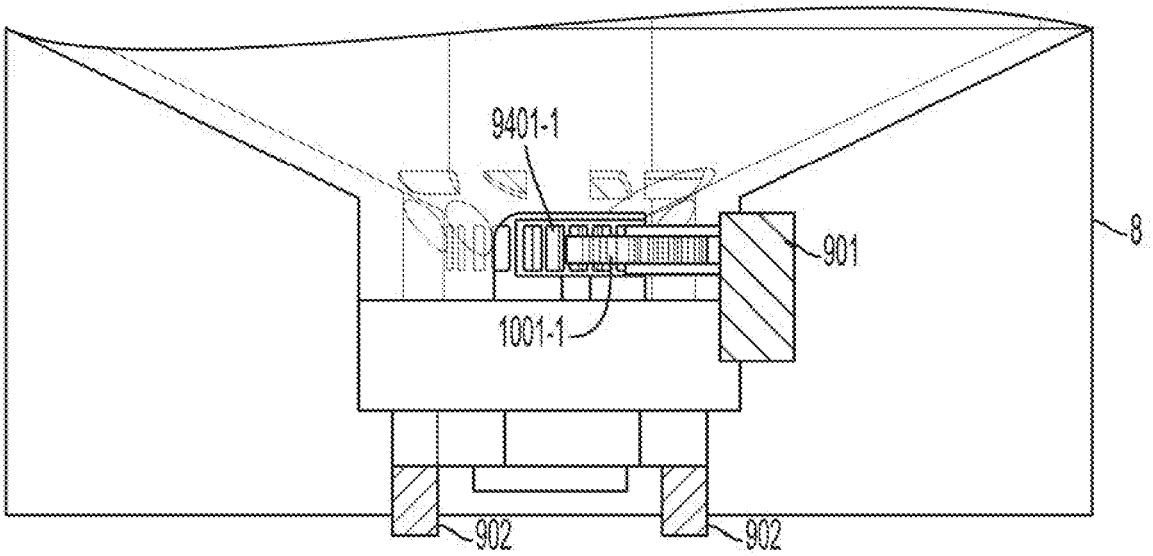
FIG. 9 is a diagram of power transfer to the device according to an example.

For example, referring to FIG. 9, the connector 9400 may include a first gear 9401-1 as the first power transfer medium to contact a second gear 1001-1 disposed at the refill port 8 to engage with the second gear 1001-1 as the second power transfer medium 1001, to be rotatable by the second gear 1001-1 receiving the power, to rotate the shaft 97 to move the plunger 93. According to an example, the connector 9400 may include a first gear 9401-1 as an activation gear to engage a second gear 1001-1 provided at the refill port 8. The connector 9400 may include an opening through which the first gear 9401-1 is accessible. The second gear 1001-1 may be provided at the refill port 8, and as the device 9 is coupled to the refill port and aligned to discharge and transfer printing material through the portal 940 at the refill port 8, the first gear 9401-1 may contact the second gear to engage with the second gear 1001-1, to receive power via the second gear 1001-1. According to an example, a power supply 400 may be an activation motor and supply rotational power to rotate the second gear 1001-1.

According to an example, FIGS. 8*a*-8*c*, the printing apparatus 1000 may comprise a power supply 400 to supply the power to the device through transference medium 901 as the power outlet 901 to drive the device to supply printing material to the printing cartridge For example, referring to FIG. 9, the device 9 may include a first gear 9401-1 rotatable to deliver power to drive the device 9 to supply printing material to the printing material container 2, and the power supply includes a second gear 1001-1 to contact the first gear 9401-1 through transference medium 901 as the power outlet 901 to engage with the first gear 9401-1 to supply power.

Figure 10:
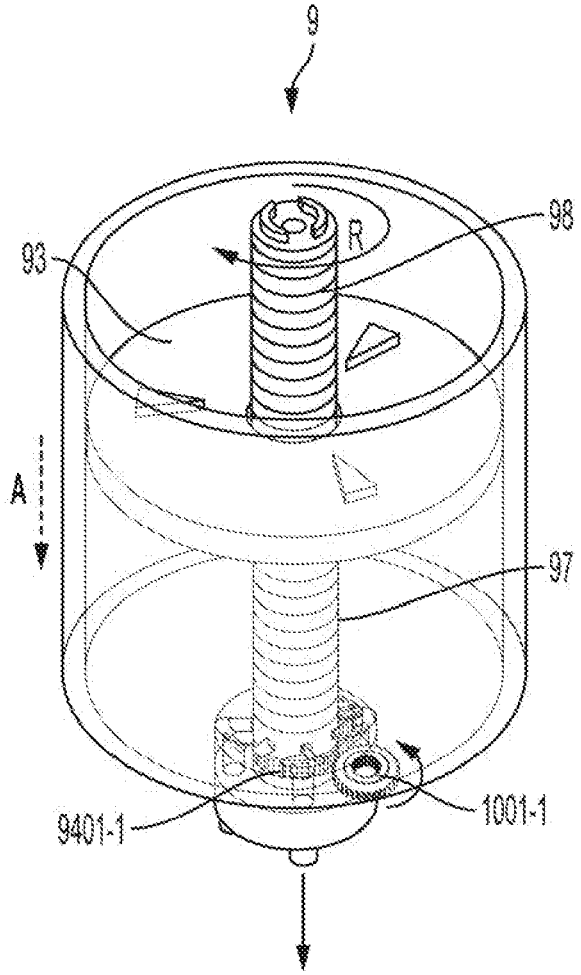
FIG. 10 is a diagram of an operation of the device by power transfer to the device according to an example.

Referring to FIGS. 9 and 10, the connector 9400 may include a first gear 9401-1 as an activation gear to engage a second gear 1001-1 provided at the refill port 8. The second gear may be provided at a position at the refill port 8, and as the device 9 is coupled to the refill port 8 and aligned to discharge and transfer printing material through the portal 940 at the refill port 8, the first gear 9401-1 may engage to the second gear 1001-1, to receive power via the second gear 1001-1.

The first gear 9401-1 may be connected to the shaft 97, so as to rotate the shaft 97 with the delivered rotational power. According to an example, the first gear 9401-1 may be directly coupled to the shaft 97 or indirectly connected to the shaft 97, to drive the shaft 97 by rotating. According to an example, the first gear 9401-1 may be included in the shaft 97, for example, by being integrated on a surface of the shaft 97. As the first gear 9401-1 is engaged to the second gear and rotates, the shaft 97 may be rotated by the first gear to move the plunger 93 along the threaded portion of the shaft 97 and in the direction A toward the portal 940, to plunge and transfer the printing material through the portal 940.

Figure 11C:
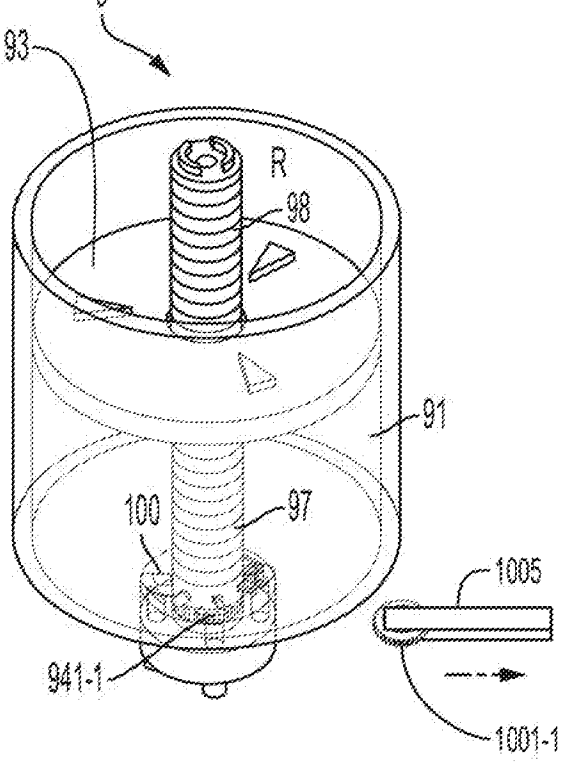
FIGS. 11*a* through 11*c* illustrate a process of engaging a first gear to a second gear according to an example.
Figure 11B:
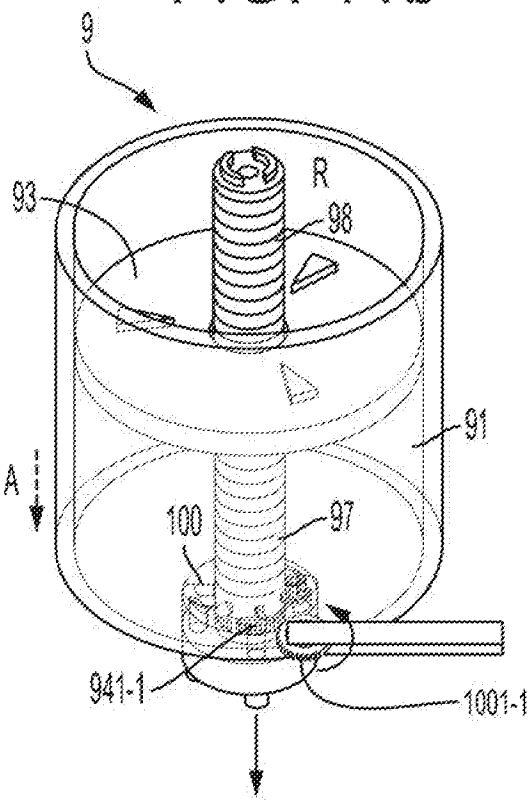
Figure 11A:
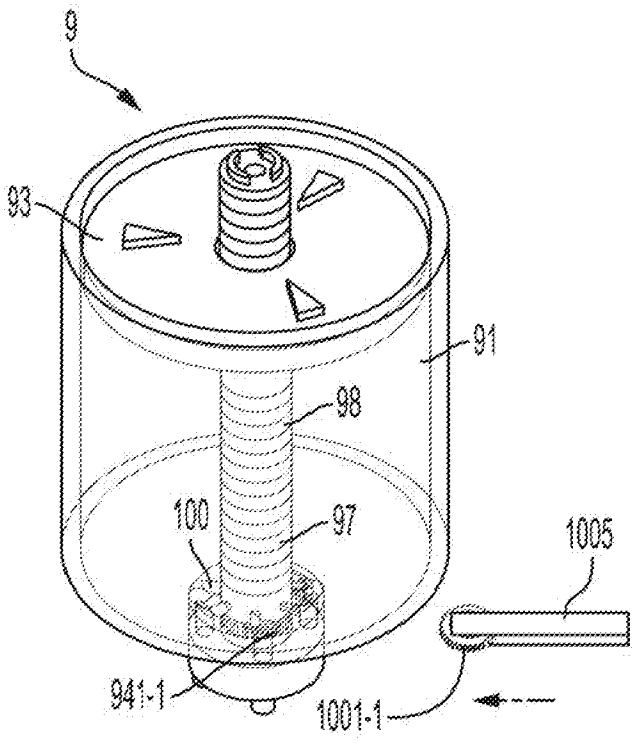

According to an example, the second gear 1001-1 may be movable to contact the first gear 9401-1 to engage with the first gear 9401-1 and be separated from the first gear 9401-1 to disengage with the first gear 9401-1. Referring to FIGS. 11*a*, 11*b* and 11*c*, the second gear 1001-1 may be provided to be movable to a first position to contact the first gear 9401-1 to engage with the first gear 9401-1 and to a second position to disengage from the first gear 9401-1. The extension shaft may couple to the second gear 1001-1 to move the second gear 1001-1 to the first position and the second position. When the first gear 9401-1 engages the second gear 1001-1, the second gear 1001-1 may rotate the engaged first gear 9401-1 to deliver rotational power.

Figure 12:
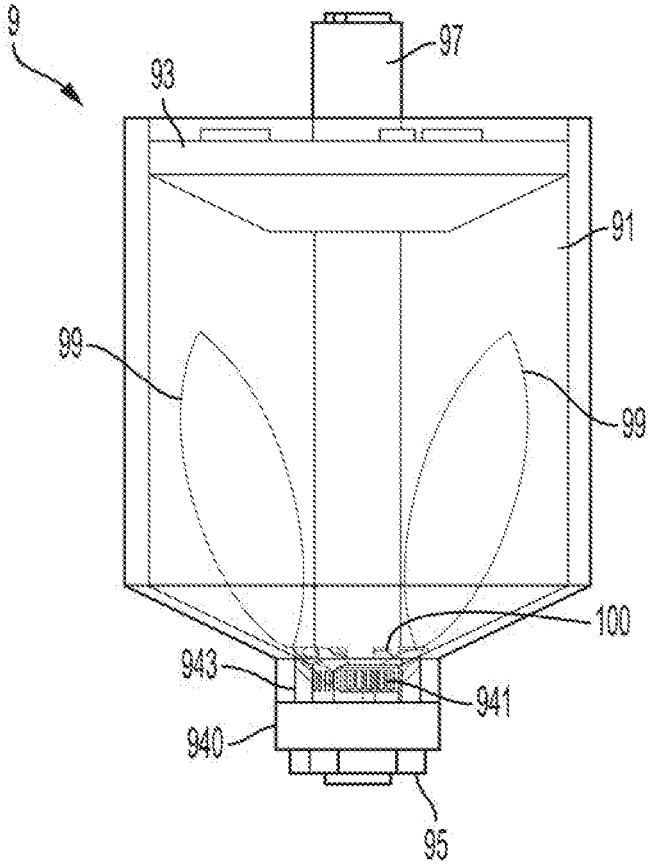
FIG. 12 is a diagram of the device including an agitator according to an example.

According to an example, the device 9 may further include an agitator 99. Referring to FIG. 12, the agitator 99 may be movable to move printing material, such that printing material can be dispersed and mixed. The agitator 99 may move to facilitate a flow of printing material and/or suppress clumping of printing material in the container 91. The agitator 99 may spin along with rotating of the shaft 97. For example, the agitator 99 may be coupled to the shaft 97. For example, the agitator 99 may be coupled to the sifting flange 100. For example, the container 91 may include an agitator 99, the agitator 99 to rotate along with rotating of the shaft 97 to move or disperse printing material around the agitator 99 in the container 91. According to an example, a plurality of agitators may be provided in the container 91 and may be coupled to various locations in the container 91, including the shaft 97 and sifting flange 100. Different forms of agitators may be used, which can facilitate a flow of printing material and/or suppress the clumping of printing material in the container 91.

For example, referring to FIG. 12, the container 91 may include an agitator 99, the agitator 99 to rotate along with rotating of the shaft 97 to disperse the printing material contained in the container 91.

Figure 13B:
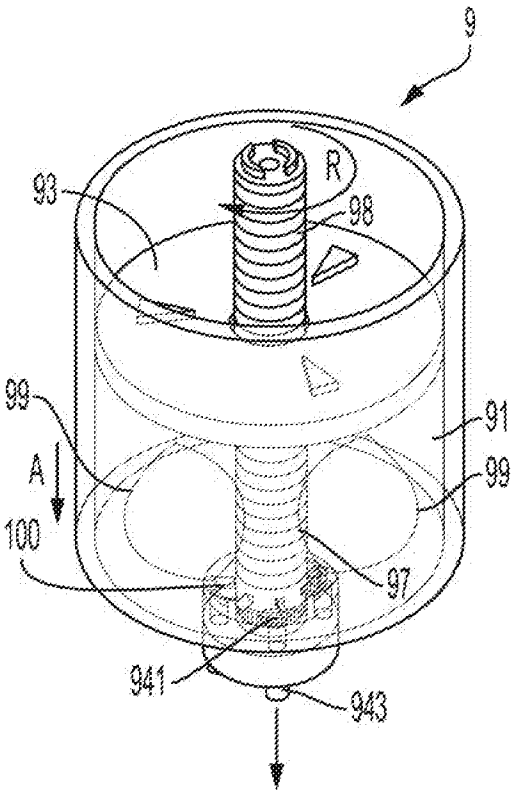
FIGS. 13*a* and 13*b* illustrate an example of an agitator that is deformable according to an example.
Figure 13A:
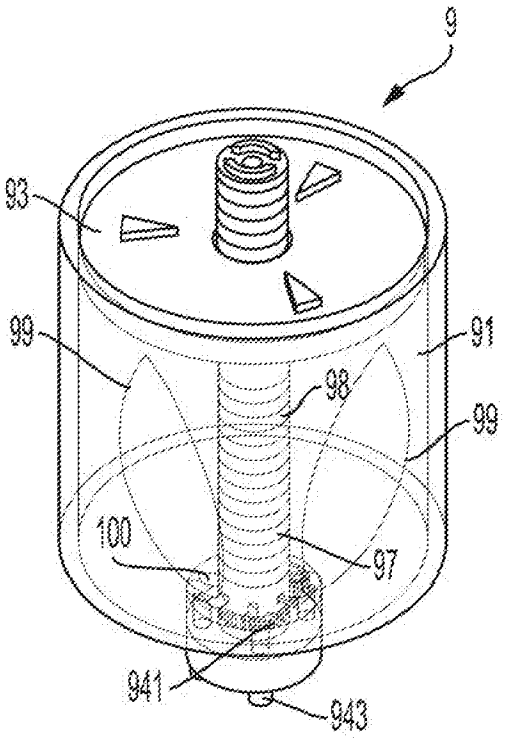

According to an example, the agitator 99 may be deformable. For example, the agitator 99 may be deformable by the plunger 93 moving toward the discharge port 943. For example, the agitator 99 may include a deformable portion made of deformable, flexible and/or pliable material such as a string or a loop, such as a wire or a wire loop, and a flexible film such as a plastic film. FIGS. 13*a* and 13*b* illustrate an example of the agitator 99 that is deformable. For example, referring to FIGS. 13*a* and 13*b*, the agitator 99 may be deformable by the plunger 93 as the plunger 93 is moved toward the discharge port 943. According to an example, referring to FIG. 13*a*, the agitator 99 may be coupled to the shaft 97 or sifting flange 100. When the shaft 97 rotates, the agitator 99 spins along with the shaft 97 to move printing material around the agitator 99, such that printing material can be dispersed and mixed. Referring to FIG. 13*b*, as the plunger 93 moves along the shaft 97 to plunge printing material contained in the container 91, the agitator 99 may be pressed to be deformed by the plunger 93 moving toward the portal 940. The agitator 99 may be deformed and spin along with the shaft 97 to continue to move printing material around the agitator 99. According to an example, the agitator 99 may be resilient and may be capable of recovering to its undeformed shape. For example, the agitator 99 may go back to its original shape when the plunger 93 is located back to its original location before plunging and stops pressing the agitator 99.

The printing apparatus 1000 may have an electrical structure, which may be for detecting whether the device 9 is coupled to the printing material refilling portion 10, and/or, through which information associated with the device 9 may be obtainable.

Figure 14:
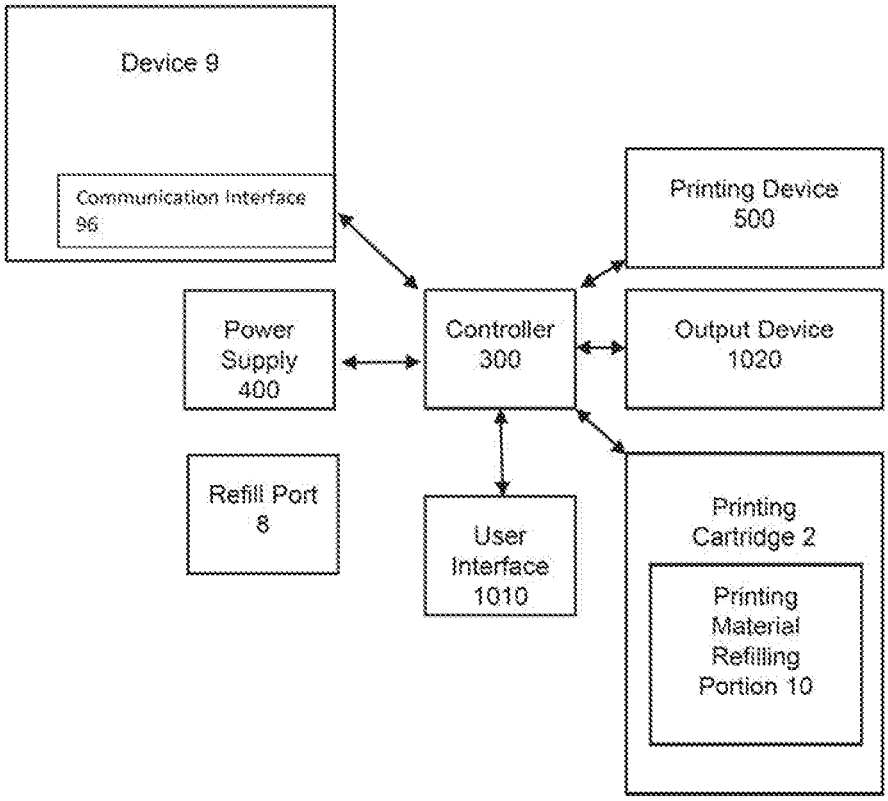
FIG. 14 is a block diagram of a printing apparatus, according to an example.

According to an example, referring to FIG. 14, the device 9 may include a communication interface 96 for communication between the device 9 and the controller 300. According to an example, the communication interface 96 may communicate with the controller wirelessly or through a wired connection. For example, the communication interface 96 may communicate with the controller 300 via a wired connection through the portal 940. When the device 9 is coupled to the printing material refilling portion 10, the communication interface 96 may be electrically connected to transfer information of the device 9. According to an example, when the device 9 is coupled to the printing material refilling portion 10 of the printing apparatus 1000, the communication interface 96 may be electrically connected to the controller via the refill port 8. According to an example, a controller 300 provided in the body 1 may obtain information to perform a control process. For example, the controller 300 may determine whether or not the device 9 is mounted based on information on the connection status of the device 9 to the refill port 8 or the printing material refilling portion 10.

According to an example, the device 9 may signal completion signal generator 92 to indicate completion of the transfer of printing material through the communication interface 96.

The printing material refilling portion 10 or the refill port 8 may be electrically connected to the device 9 coupled to the printing material refilling portion 10 and the body 1 and may transmit the information about the device 9 and the information about the printing material container 2 to the controller 300 through the interface between the printing material container 2 and the body 1. The information about the device 9 may include information for authentication of the device 9 and the information about the printing material container 2 may include information for authentication of the printing material container 2. The controller 300 may control operations of the printing apparatus 1000 based on signals or information received through a plurality of electrical contacts. The controller 300 may be a controller for a printing apparatus 1000. The controller 300 may be a controller implemented in the printing apparatus, for example, as a separate controller or integrated with the controller of the printing apparatus 1000. The controller 300 may be physically separated from the printing apparatus, such as an independent remote controller, a client device or a server in communication with the printing apparatus.

FIG. 14 is a block diagram of a printing apparatus 1000 according to an example. With reference to FIG. 14, the printing apparatus 1000 may also include a user interface 1010 which provides a user with information regarding whether the device 9 is coupled to the printing material refilling portion 10. By providing such information to a user, the user can know whether the device 9 is successfully or unsuccessfully coupled to the printing material refilling portion 10. When the device 9 is coupled to the printing material refilling portion 10 and ready or aligned to discharge and transfer printing material to the printing material container 2, power can be delivered to the device 9 to perform a plunging operation to discharge the printing material from the device 9 to the printing material container 2. When the device 9 is not fully coupled to the printing material refilling portion 10 or not aligned to discharge printing material to the printing material container 2, power may not be delivered to the device 9 to avoid an erroneous operation.

When the device 9 is coupled to the printing material refilling portion 10, the device 9 may be connected to the controller 300. The controller 300 may read information about the device 9 from the device 9. The information about the device 9 may include information for authentication of the device 9. Therefore, the controller 300 may receive the information about the device 9. The controller may also receive the information about the printing material container 2 through the interface between the printing material container 2 and the controller 300.

According to an example, the printing material refilling portion 10 may include an alignment detection sensor to detect that the device 9 coupled to the printing material refilling portion 10 enters a certain position depending on the alignment of the device 9. The printing material refilling portion 10 may transmit whether or not the mounted device 9 has reached a certain position by rotation to the controller 300, based on a result of the detection of the device 9. For example, the printing material refilling portion 10 may transmit a signal indicating that the device 9 is improperly coupled to the printing material refilling portion 10 or not aligned to discharge printing material to the printing material container 2, that the device 9 is arranged to discharge and transport printing material, and/or that the printing material refilling portion 10 is ready to receive printing material from the device 9 when the device 9 is aligned to discharge printing material.

According to an example, the controller 300 may communicate with at least one among the printing material container 2 including the printing material refilling portion 10, the refill port 8, the device 9, and the power supply 400. According to an example, a controller to meter, detect or measure an amount of printing material supplied by the device. For example, the controller 300 may meter an amount of printing material in the printing material container 2. For example, the controller 30 may meter the amount of printing material in the device 9. For example, the controller 300 may control power supply 400 to control the device 9 to supply printing material to the printing material container 2, based on information received from at least one among the printing material container 2 including the printing material refilling portion 10, the refill port 8, the device 9, and the power supply 400.

Figure 15B:
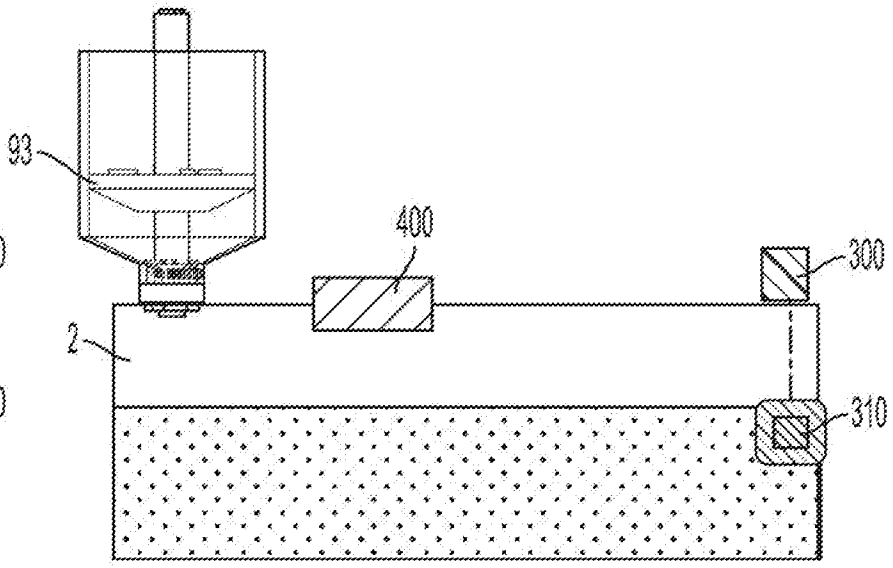
FIGS. 15*a* and 15*b* illustrate a printing material refill process controlled by a controller.
Figure 15A:
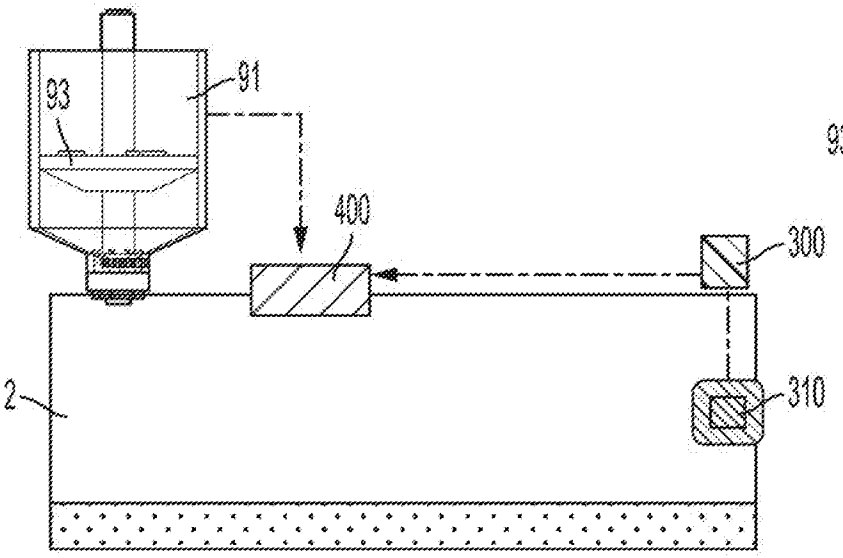

According to an example, the plunger 93 is movable based on an amount of printing material contained in the printing material container 91. According to an example, referring to FIGS. 15*a* and 15*b*, the plunger 93 as a piston 93 may be to move based on an amount of printing material contained in the printing material container 2 before the transfer of the printing material contained in the container 91. According to an example, the controller 300 may control a process of printing material refill process, such as initiation and completion of the printing material refill process. For example, referring to FIGS. 14 and 15*a*-15*b*, the printing apparatus 1000 may include a controller 300 to control an amount of printing material supplied by the device 9, based on an amount of printing material in the printing material container 2. The controller 300 may be to control the amount of printing material supplied by the device 9, based on the amount of printing material in the device 9. According to an example, various types of sensors may be provided. For example, a sensor 310 to detect an amount of toner in the printing material container 2 may be provided. Different types of sensors to detect the amount of toner may be implemented, including a weight sensor and an optical sensor. According to an example, the controller may calculate an amount of printing material consumed by the printing apparatus 1000 based on a printing task of the printing apparatus 1000. For example, the controller may calculate an amount of printing material consumed by the printing apparatus 1000 based on the printing data used to perform the printing task. For example, the controller 300 may calculate how much printing material in the printing material container 2 is consumed by counting the number of pixels of an image indicated in an image data used for printing an image on a printing medium. According to an example, the device 9 may provide information to indicate an amount of toner that can be discharged and transferred to the printing material container 2. Based on such various information and detections by the sensor 310, the controller 300 may determine an amount of printing material to be discharged and transferred from the device 9 to the printing material container 2, and may control the printing apparatus according to a result of the detection. For example, the controller 300 may control to initiate and stop supply power to the device 9.

In order to remove the device 9, the device 9 may be rotated in a direction opposite to a direction in which the device 9 is rotated after being coupled to the printing material refilling portion 10.

The printing apparatus 1000 may be controlled to output information regarding the device 9 being separated from the printing material refilling portion 10. For example, a message may be presented on a screen of the user interface 1010 regarding a status of alignment or separation of the device 9, or a light indication may be provided. Further the output may be in the form of haptic feedback presented through the user interface 1010, or a sound generated by an output device 1020 such as a speaker, which may also provide a user information regarding separation of the device 9 from the printing material refilling portion 10. The user interface 1010 and output device 1020 may be combined as a single device where the user interface 1010 includes the output device 1020 or vice versa.

While various examples have been described with reference to the drawings, it will be understood that various changes in form and details may be made therein without departing from the spirit and scope as defined by the following claims.

What is claimed is:

1. A device to supply printing material to a printing material container of a printing apparatus, the device comprising:

a container including a plunger and to contain the printing material;

a portal couplable to a refill port to the printing material container, the portal including a discharge port through which the printing material is transferrable from the container, and a connector to receive power to move the plunger, to cause a transfer of the printing material contained in the container to the printing material container through the discharge port.

2. The device of claim 1, further comprising:

a shaft rotatable to move the plunger toward the discharge port, to cause the transfer of the printing material.

3. The device of claim 2, wherein the shaft includes an engaging portion to engage the plunger, and the plunger is to engage with the engaging portion to be movable by rotating of the shaft along the engaging portion, to cause the transfer of the printing material.

4. The device of claim 2, wherein the container includes an agitator to rotate along with rotating of the shaft to move printing material around the agitator in the container.

5. The device of claim 4, wherein the agitator is deformable by the plunger moving toward the discharge port.

6. The device of claim 2, wherein the shaft includes a sifting flange disposed adjacent to the discharge port, the sifting flange to rotate along with the shaft to sift the printing material toward the discharge port.

7. The device of claim 2, wherein the connector includes a first gear to contact a second gear disposed at the refill port to engage with the second gear, to be rotatable by the second gear receiving the power, to rotate the shaft to move the plunger.

8. The device of claim 1, wherein the plunger is movable based on an amount of printing material contained in the printing material container.

9. The device of claim 1, further comprising:

a locking structure including a first locking piece having a first portion of the discharge port, and a second locking piece having a second portion of the discharge port, wherein at least one among the first locking piece and the second locking piece is movable to connect the first portion and the second portion to form an opening of the discharge port and to disconnect the first portion from the second portion to close the opening of the discharge port.

10. A printing apparatus to include a printing material container coupleable to a device, the printing apparatus comprising:

a refill port through which the device including printing material is couplable to the printing material container and to receive power to drive the device to supply the printing material included in the device to the printing material container.

11. The printing apparatus of claim 10, wherein the refill port includes a power transference medium through which the device is to receive the power to drive the device.

12. The printing apparatus of claim 11, further comprising:

a power supply to supply the power to the device through the power transference medium to drive the device to supply printing material to the printing material container.

13. The printing apparatus of claim 12, wherein the device includes a first gear rotatable to deliver power to drive the device to supply printing material to the printing material container, and the power transference medium includes a second gear to contact the first gear through the refill port to engage with the first gear to supply the power.

14. The printing apparatus of claim 10, further comprising:

a controller to meter an amount of printing material in the printing cartridge.

15. The printing apparatus of claim 14, wherein the controller is to meter the amount of printing material in the device.

* * * * *